United States Patent [19]

Finlayson

[11] 4,128,183

[45] Dec. 5, 1978

[54] STRADDLE-TYPE LIFT TRUCK WITH A APPARATUS FOR HANDLING LOADS AT THE FRONT AND SIDES THEREOF

[75] Inventor: Thomas J. Finlayson, Palos Hills, Ill.

[73] Assignee: Allis-Chalmers Corporation, Milwaukee, Wis.

[21] Appl. No.: 751,134

[22] Filed: Dec. 16, 1976

[51] Int. Cl.[2] ..... B66F 9/06

[52] U.S. Cl. ..... 214/730; 187/9 E

[58] Field of Search ..... 214/730–731, 214/660, 670–674, 16.4 A, 750, 16 B; 187/9 R, 93 E; 212/10–11, 123–126

[56] References Cited

U.S. PATENT DOCUMENTS

| | | | |
|---|---|---|---|
| 3,202,242 | 8/1965 | Dolphin | 214/730 X |
| 3,643,825 | 2/1972 | Zane | 215/670 X |
| 3,836,031 | 9/1974 | Weisker et al. | 214/730 |
| 3,841,503 | 10/1974 | Hollenbach | 214/730 |
| 3,869,047 | 3/1975 | Keen et al. | 214/730 X |
| 3,948,356 | 4/1976 | Keen | 214/730 X |
| 4,034,881 | 7/1977 | Heinold et al. | 214/730 X |

FOREIGN PATENT DOCUMENTS

| | | | |
|---|---|---|---|
| 257298 | 9/1964 | Australia | 214/16.4 D |
| 1026688 | 3/1958 | Fed. Rep. of Germany | 214/730 |
| 1506984 | 7/1969 | Fed. Rep. of Germany | 212/125 |
| 1902465 | 8/1969 | Fed. Rep. of Germany | 214/730 |

*Primary Examiner*—Francis S. Husar
*Assistant Examiner*—R. B. Johnson
*Attorney, Agent, or Firm*—Robert C. Jones

[57] ABSTRACT

A high density, high lift storage loader having facilities for sideloading, floor loading and front loading a standard beam-type pallet rack and also having a capability of providing means for order picking adjacent the operation. The arrangement provides a straddle-type high-lift apparatus provided with straddles which are located at the height of the first shelve of the storage structure. The load is carried on a chain-type mechanism and is rotatably mounted to the lifting carriage of the machine by a drive ring. The drive ring is movable longitudinally along the carriage support arms and is coordinated with locating and reaching movements. An operator carriage moves with the load carrier so that the operator controls the apparatus at all times with the load in view. Floor loading is accomplished without the necessity of a counterbalance.

2 Claims, 6 Drawing Figures

10
11
12
111
113
14
16
18
21
23
26
30
36
37
38
43
46
48
49
51
59
61
62
66
68
71
72
76
78
83
86
88
94
95
96
101
107

STRADDLE-TYPE LIFT TRUCK WITH A APPARATUS FOR HANDLING LOADS AT THE FRONT AND SIDES THEREOF

BACKGROUND OF THE INVENTION

This invention relates to four quadrant-loading article handlers and more particularly to a straddle-type loader wherein the operator station moves with the load.

As is known, industries are constantly faced with the problems of the lack of space for storage of industrial goods, parts, rolls, cases and the like. Since enclosing space for storage purposes has increasingly become more and more expensive, the trend has been to construct relatively high storage facilities to avoid lateral expansion which requires greater land use. Thus, the density of storage facilities has increased with minimum aisle space being provided. Thus, order-picker trucks are commonly used wherein the operator stands on the platform on the fork of the truck and the platform elevates to the desired height in the storage area. The articles are then manually moved either from the shelves or bins to the truck platform or from the truck platform to the storage shelves. This, of course, is a hazardous, time consuming and arduous process.

Prior art shows various approaches to the problem. U.S. Pat. No. 3,643,825 discloses a side-loading handling device which incorporates a carriage adapted to be moved at right angles to the prongs of the fork. A turntable is rotatably mounted on the carriage and includes a mast structure which, in turn, is provided with a carriage adapted to be moved vertically. The arrangement disclosed is, in effect, a double order-picker arrangement, each acting independently of the other to perform its function. U.S. Pat. No. 3,323,664 discloses a side-loading fork truck which includes an upright post or mast that is fixedly mounted on the truck body and supports a vertically movable carriage. A guide arrangement is mounted on the carriage for angular movement about a vertical axis. A load-handling fork is arranged on the frame for guided movement in a horizontal plane. U.S. Pat. No. 3,202,242 discloses a truck having a mast and a lifting carriage supported thereon. On the carriage, there is a turntable which is supported by the mast. On the turntable is a guide means for a horizontally movable carriage which supports a fork arrangement for reaching purposes. German Pat. No. 1,026,668 discloses a truck having a vertically movable mast adapted to carry a frame, the frame being mounted on the mast for transverse movement relative to the mast. A fork mechanism is carried by the frame for movement with it and for rotation and lateral movement.

SUMMARY OF THE INVENTION

It is an object of the present invention to provide an improved high density, high-lift load-handling apparatus which can side load, floor load, front load and rear face standard pallets in standard beam-type pallet racks.

It is another object of the present invention to provide an improved high-lift load-handling apparatus which can floor load without requiring a counterbalance truck arrangement.

Still another object of the present invention is to provide a straddle-type apparatus which is more stable at high-lift heights.

According to the preferred embodiment of the present invention, a straddle-type high-lift apparatus is provided with straddles which are located at the height of the first shelve of the storage structure. The load is carried on a chain-type mechanism and is rotatably mounted to the lifting carriage of the machine by a drive ring. The drive ring is movable longitudinally along the carriage support arms and is coordinated with locating and reaching movements. An operator carriage moves with the load carrier so that the operator controls the apparatus at all times with the load in view. Floor loading is accomplished without the necessity of a counterbalance.

Other features and objects of the invention that have been attained will appear from the following detailed description of the invention in conjunction with the accompanying drawings.

DESCRIPTION OF THE INVENTION

Figure 1:
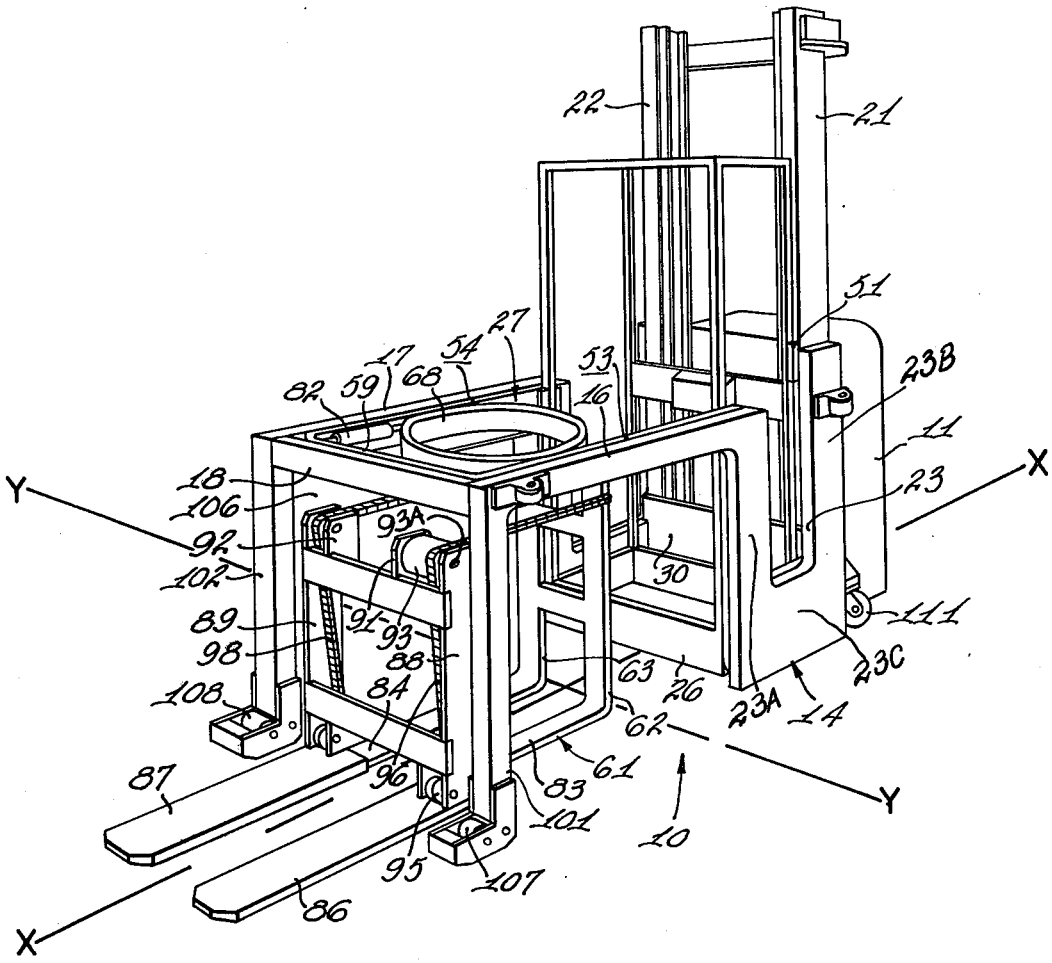
FIG. 1 is a perspective view of the improved straddle-type, high-lift loading and unloading apparatus.
Figure 2:
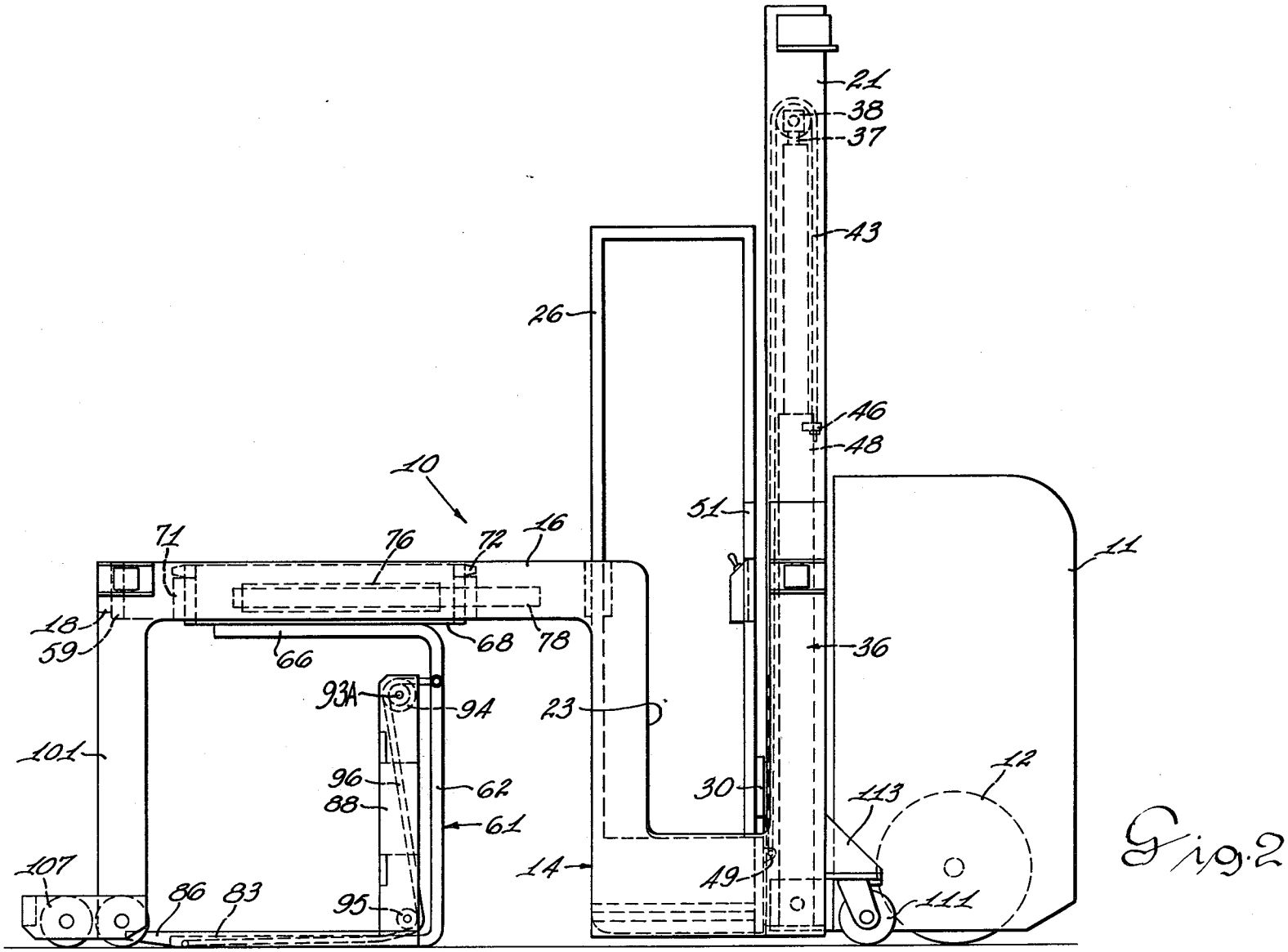
FIG. 2 is a view in left-side elevation of the apparatus of FIG. 1 with its extendible forks retracted.
Figure 3:
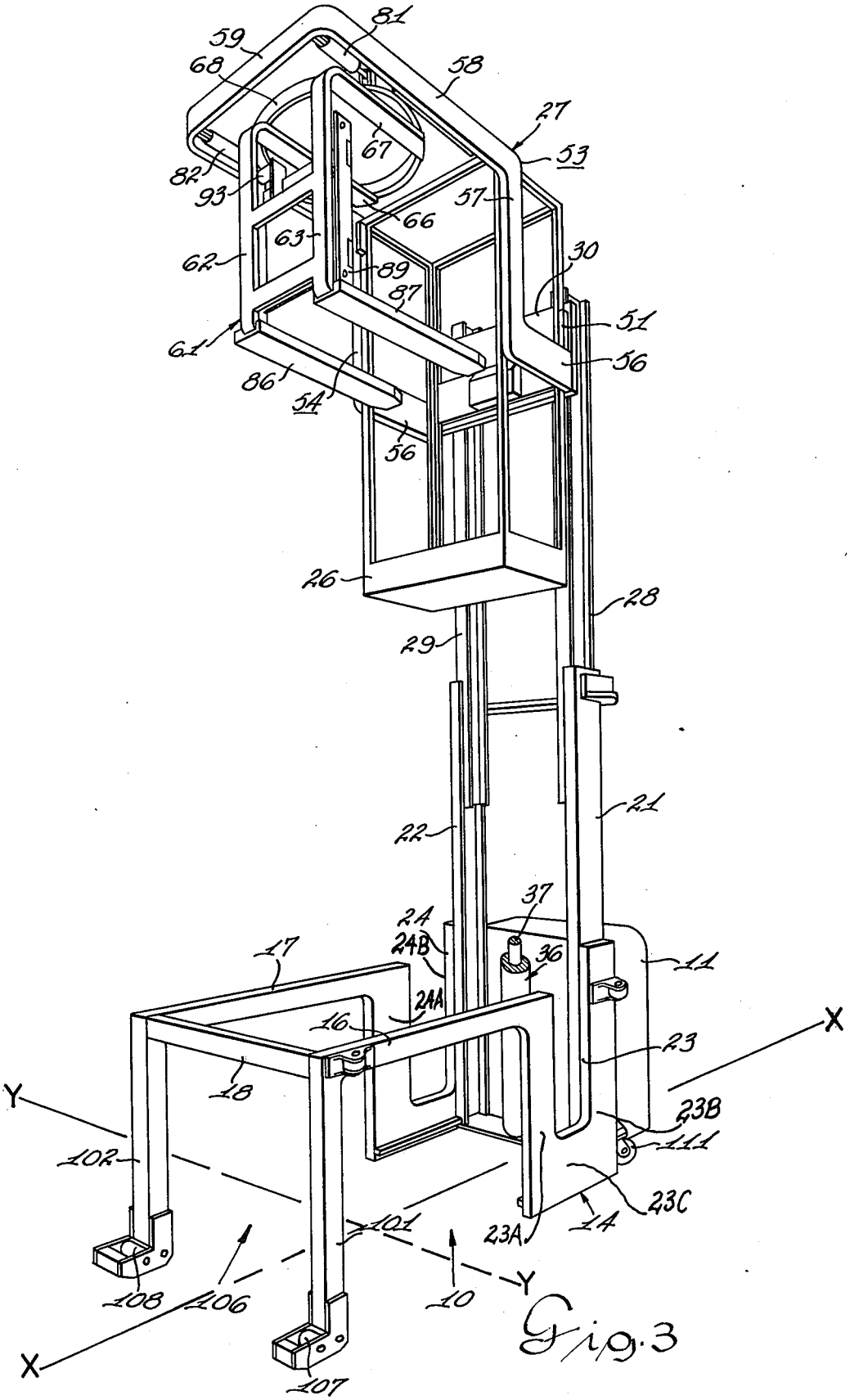
FIG. 3 is a perspective view of the straddle apparatus in high-lift position with the forks rotated in operator-facing relationship as in order-picking use, parts being omitted for clarity.
Figure 4:
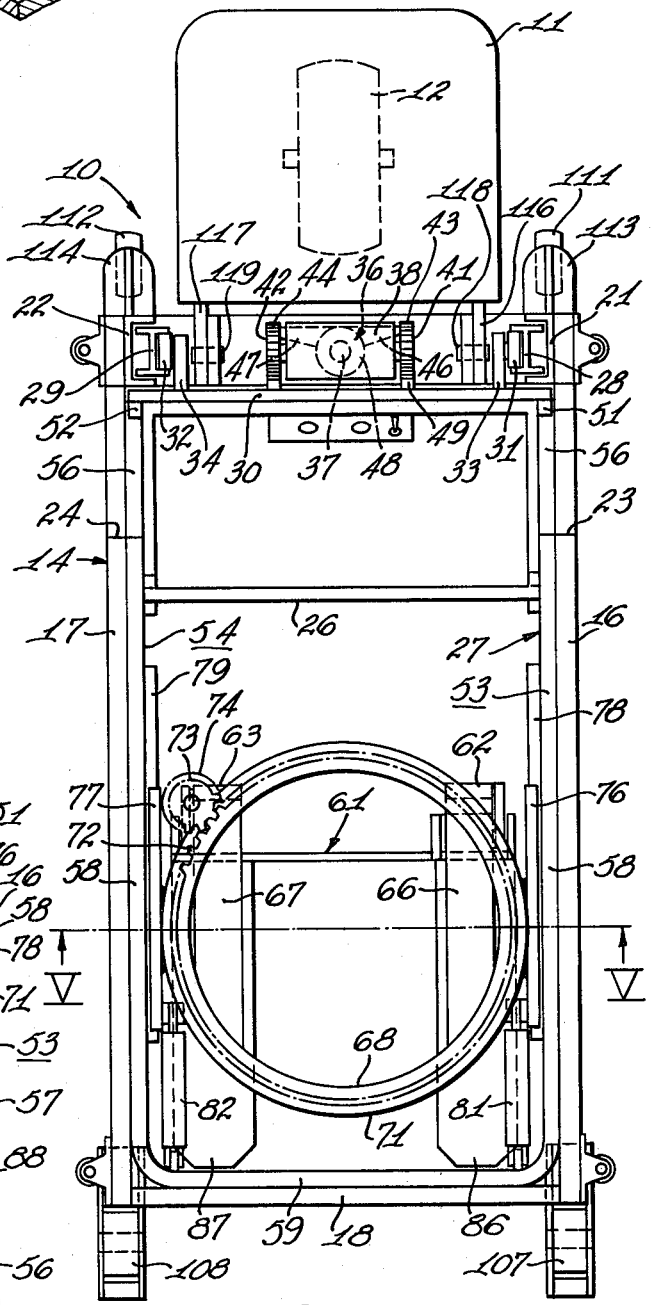
FIG. 4 is a plan view of the vehicle.

Referring now to the drawings and particularly to FIGS. 1, 2 and 3, there is shown a straddle-type apparatus 10 which includes a power unit 11 having a single steerable wheel 12. Forward of the power unit 11 is a main frame 14 which provides straddle support for the load. The main frame 14 has a major axes x-x and a minor axes y-y includes a pair of spaced-apart forwardly extending side piece members 16 and 17 which are tied together at their forward ends by a transverse structural horizontal member 18. At their inner ends, the side pieces 16 and 17 are secured to vertically extending spaced-apart mast channels 21 and 22. Adjacent the power unit 11, the side pieces 16 and 17 are provided with vertical entrance openings 23 and 24 defined by spaced apart vertical members 23A and 23B which are connected together by a horizontal member or stile 23C. The upper end of the vertical member 23A is integrally formed with the horizontal top arm member 19 of the side member 16, respectively, which provide easy access for the operator into an operator carrier 26 which is supported for vertical movement adjacent the mast assembly;

To this purpose, a carriage or elevator 27 is supported for vertical movement by inner channel mast extensions 28 and 29. This is accomplished by means of roller sets 31 and 32 carried by extensions 33 and 34 that are secured as by welding to an elevator plate 30, as shown in FIG. 4. Vertical movement of the elevator 27 is effected by operation of a fluid motor 36. The upper end of the fluid motor piston rod 37 is provided with a sprocket carrier 38, FIGS. 2 and 4, having a pair of gear sprockets 41 and 42 rotatable supported thereon. Chains 43 and 44 are entrained over the sprockets 41 and 42. The chains each have one end secured to lateral extending lugs 46 and 47 that are secured as by welding to the cylinder 48. The opposite ends of the chains are secured to a pair of elevator plate lugs 49, one of which is shown in FIG. 2. Thus, as the drive means such as fluid motor 36 is operated in an elevating movement, the rod 37 is extended, which, in turn, effects movement of the chains 43 and 44 and thereby the elevator 27. The elevator, upon being moved upwardly a predetermined distance, causes the operator carriage to move upwardly. This is accomplished through bar members 51 and 52 that are welded to the rear corner uprights of the operator carrier being engaged by the upper edges of forwardly projecting side arms 53 and 54 of the elevator 27. Thus, continued upward movement of the elevator 27 serves to effect upward movement of the operator carriage 26.

The elevator 27 includes the side arms 53 and 54 which are attached as by welding to the elevator plate 30 and extend forwardly thereof snugly fitting to the inner surface of the adjacent side pieces 16 and 17. The side arms 53 and 54 are configured to conform with the side pieces 16 and 17 of the main frame 14. Thus, side arms have a forwardly projecting lower sill portion 56 terminating at a vertical upwardly projecting post member 57 which joins an upper forwardly projecting extension member 58. The extension members 58 of each of the forwardly projecting side arms 53 and 54 are rigidly joined together by a transverse tie bar 59 which is shown as being an integral part of the extensions. Thus, as the elevator 27 is moved upwardly, the operator carriage 26 is moved upwardly so that the operator has visual surveillance of the load carried by the elevator 27 at all times.

Figure 5:
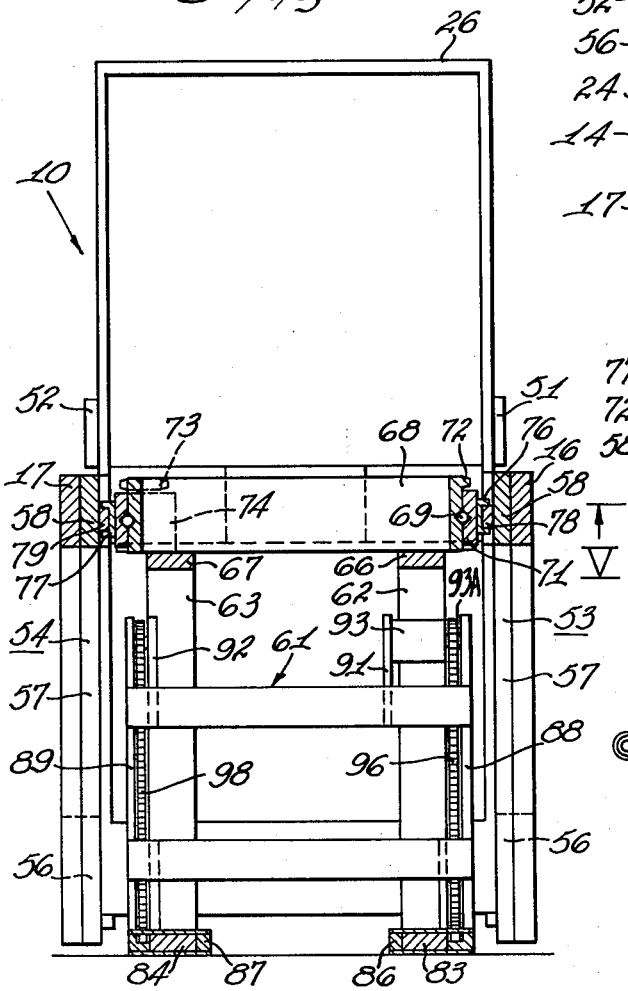
FIG. 5 is a view in vertical section through the rotary drive taken in a plane represented by the line V—V in FIG. 4; and, FIG. 6 is a fragmentary showing of the extensible fork support and drive arrangement.

The elevator 27 operatively supports a forkloading member 61 by which means pallets or pallet boxes and the like are engaged and loaded for high-lift placement. As shown, the fork-load carrier member 61 includes a pair of J-configured spaced-apart load-carrying support lifts 62 and 63. The upper legs 66 and 67 are secured to the under edge of a drive ring gear 68 which is operatively supported between the elevator extension members 58 for 360° of rotation and also for movement parallel to the longitudinal axis of the machine. To this end, the gear drive ring 68 is supported for rotation by ball bearings 69, shown in FIG. 5, which are confined in operative position by a circular cage 71. The upper outer peripheral edge of the drive gear 68 is provided with gear teeth 72 which are adapted to be meshingly engaged by the gear teeth of a drive pinion 73. The drive pinion 73 is drivenly secured to the extending end of a drive shaft of a drive motor 74 which is secured to a slide 77.

The bearing cage 71 is, in turn, secured between channel configured slides 76 and 77 which are slidably engaged on guides 78 and 79, respectively. Guides 78 and 79 are, in turn, welded or screw-fastened to the inner side surfaces of the elevator arm extensions 58 and 59, respectively. A pair of fluid motors 81 and 82 connected between the tie bar 59 and the slides 76 and 77 are operative to effect selective advance and retraction movement of the drive gear 68.

Figure 6:
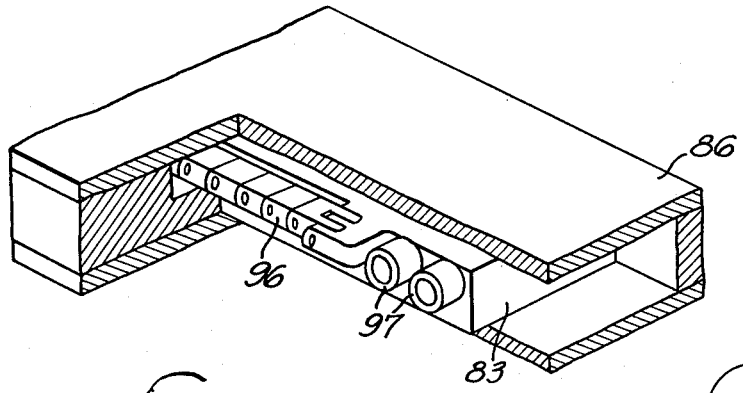

A fork extension is provided to extend the reach of the fork-load carrier member 61. To this end, the horizontal fork prongs 83 and 84 are each provided with movable prong extensions 86 and 87, as best shown in FIGS. 1, 2 and 6. The prong extensions 86 and 87 each include upright side rear plates 88 and 89, and spaced apart therefrom, short vertically disposed reinforcing plates 91 and 92. A fluid motor 93 is secured to plate 91 and has the extending end of its associated drive shaft journaled in the plate 88. A sprocket gear 94, FIG. 2, is secured to the motor shaft to rotate with it. As best shown in FIG. 2, a chain 96 is entrained over the sprocket gear 94 with the end thereof being secured to the lift 62. The chain 94 carries downwardly from the sprocket gear 94 and runs under a sprocket idler 95 and thence forward therefrom to the forward end of the fork prong 83 where it is secured. As shown in FIG. 6, the fork prong 83 is provided with a plurality of support rollers 97 which provide rolling guidance to the extension 86 as it moves over the fork prong 83. A similar arrangement obtains for the fork prong 84 and its associated extension 87, the exception being that the chain 98 is not power driven and serves as an equalizer. Thus, as the motor 93 is operated to rotate the sprocket 94 in a clockwise direction, as viewed in FIG. 2, a reaction force is developed which moves the extensions 86 and 87 forward to reach position. Operation of the motor 93 in the opposite direction will cause the extensions 86 and 87 to be retracted.

It will be appreciated that in addition to providing increased reaching capabilities, the fork extension arrangement effectively prevents the downward tilting of the extended fork. This provides an additional safety factor against inadvertent loss of a pallet load.

The dual movement arrangement for the drive gear 68 provides for precise adjustment in the position of the fork-load carrier member 61 in side loading or unloading operation. In this respect, at high-lift side loading or unloading, the fork-load carrier member 61 can be moved in either direction selectively parallel to the major axis of the apparatus. This capability eliminates the necessity of rocking the entire machine with the fork-loading member in elevated position for effecting retrieval or disposition of a load.

Stability of the main frame 14 is afforded by the forward vertical legs 101 and 102 which are shown as being integral with the associated side pieces or members 19 and 19A of the side members 16 and 17, respectively. A cross brace 103 reinforces the structure without interferring with front load opening 106. The lower ends of the legs 101 and 102 include rollers 107 and 108 which provide mobility to the forward end of the straddle. The rear portion of the straddle adjacent the power unit 11 is given mobility by operation of a pair of caster rollers 111 and 112 which are carried by brackets 113 and 114 welded or bolted to the rear of the lower mast portion 21 and 22, respectively. A drive connection between the power unit 11 and the main frame 14 is effected by interrelated bracket pairs 116 and 117 which are pivotally connected together by pins 118 and 119.

From the foregoing description, it can be seen that an improved order-picker device 10 has been provided which facilitates high-lift loading and provides for greater stability of the machine under all load conditions.

The embodiments of the invention in which an exclusive property or privilege is claimed are defined as follows:

1. In a high-lift load-handling apparatus;

a mobile frame having spaced-apart side members with each side member having a forward vertical support leg, each leg being provided with mobile supports, said frame having a major axis and a minor axis;

support wheels operably connected to a respective one of said vertical support legs;

a mast structure having at least one extensible element carried by said frame;

a power actuator carried by said frame and operably connected to effect the controlled movement of said extensible element of said mast structure in an extending and retracting movement;

an operator carrier supported by said frame between said side members for vertical movement;

a vertically movable load elevator carrier by said extensible element of said mast structure to movement with it;

means on said load elevator engageable with said operator carrier to effect vertical movement of said operator carrier;

a load carrier supported by said load elevator for movement with said load elevator and for independent movement about a vertical axis and in a direction parallel to the major axis of said frame;

a load access opening defined by each of said frame side members and said forward vertical support legs also define between them a load access opening through which said load carrier can be moved in a load-engaging or load-depositing operation;

actuating means carried by said load elevator and operably connected to said load carrier for effecting the selective independent movement of said load carrier about a vertical axis and in a direction parallel to the major axis of said frame;

an elongated guide means secured to said load elevator and extending in a direction parallel to the major axis of the apparatus;

slide means slidably engaged on said guide means;

slide power actuating means carried by said load elevator and operably connected to effect selective movement of said slide means relative to said guide means in either direction along said major axis;

a circular bearing cage secured to said slide means for movement with said slide means;

a drive ring gear rotatably supported in said circular bearing cage for selective rotation in either direction about a vertical axis;

antifriction bearings operably captured between said bearing cage and the external surface of said drive ring gear and operable to support said drive ring gear;

a ring gear power drive motor carried by said slide means of said load elevator and operably connected to effect rotation of said drive ring gear relative to said slide means; and, means securing said load carrier to said drive ring gear;

whereby said drive ring gear can be rotatably driven to effect the movement of said load carrier to any desired angular position with respect to the major and minor axis of the apparatus and said slide can be moved with respect to the major axis of the apparatus to effect a desired positioning of the angularly positioned load carrier with respect to the major axis of the apparatus.

2. A high-lift load-handling apparatus according to claim 2 wherein said load carrier is a fork loader having load-receiving main prong members;

auxiliary extensible prongs carried by said main prong members for movement relative thereto; and, a power actuator carrier by said load carrier and operably connected to said slide means to effect the extension and retraction of said auxiliary prongs relative to said main prong members;

whereby the reach of said load carrier is extended.

* * * * *